United States Patent [19]

Fond

[11] 4,011,827

[45] Mar. 15, 1977

[54] MACHINE FOR CLEANING THE BOTTOM OF BOATS

[76] Inventor: Ben Fond, 13955 Tahiti Way, Marina del Rey, Calif. 90291

[22] Filed: Jan. 12, 1976

[21] Appl. No.: 648,208

[52] U.S. Cl. ..... 114/222; 15/1.7

[51] Int. Cl.[2] ..... B63B 59/00

[58] Field of Search ..... 114/222; 15/1.7, 28, 15/DIG. 2

[56] References Cited

UNITED STATES PATENTS

| | | | |
|---|---|---|---|
| 487,198 | 11/1892 | McCutchan | 114/222 |
| 732,082 | 6/1903 | Johnson | 114/222 |
| 1,079,208 | 11/1913 | Browne | 114/222 |
| 3,227,124 | 1/1966 | Campbell | 114/222 |
| 3,396,423 | 8/1968 | Hope | 114/222 |
| 3,471,884 | 10/1969 | Wright | 15/1.7 |
| 3,561,391 | 2/1971 | Locati | 114/222 |
| 3,628,489 | 12/1971 | Michaelson | 114/222 |
| 3,800,732 | 4/1974 | Hill | 114/222 |
| 3,906,572 | 9/1975 | Winn | 114/222 |

*Primary Examiner*—Trygve M. Blix
*Assistant Examiner*—Stuart M. Goldstein
*Attorney, Agent, or Firm*—Spensley, Horn, Jubas & Lubitz

[57] ABSTRACT

A boat hull cleaning apparatus having a plurality of uniquely designed brushing units is disclosed. The apparatus comprises a plurality of brushing devices each device being disposed in an associated housing. The brushing device comprises a rotatable base member having an axis of rotation, and a plurality of cleaning bristles extending outwardly from the base member. The bristles are disposed on the base member so as to be substantially parallel to the axis of rotation. A motor is disposed in the housing having a rotatable shaft. The brushing device is disposed at one end of the shaft and a propeller is disposed at the other end of the shaft. Rotation of the shaft causes (i) the propeller to drive the housing toward the boat hull; and (ii) the base member to rotate about its axis. The boat hull cleaning apparatus of the present invention has particular utility in thoroughly cleaning various shaped boat hulls and removing tenacious growths therefrom.

10 Claims, 7 Drawing Figures

10
12
14
16
18
19
20
22
24
25
25a
26
28
30
32
38
40
60
61
62
64
66
68
70
72
74
76
82
84
95
100
108
110

12
14
16
19
25
25a
62
64
70
72
74
78
80
84
102
104
150

12
14
16
19
22
25
25a
38
40
85
87
89
91
93
94
102
104
150

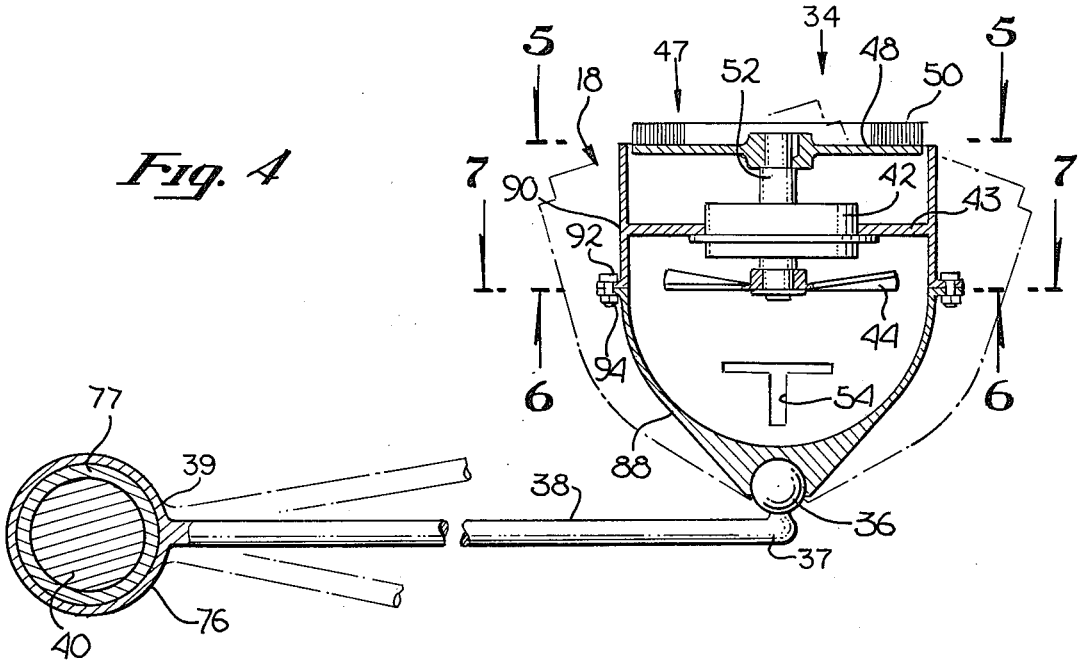
Fig. 4
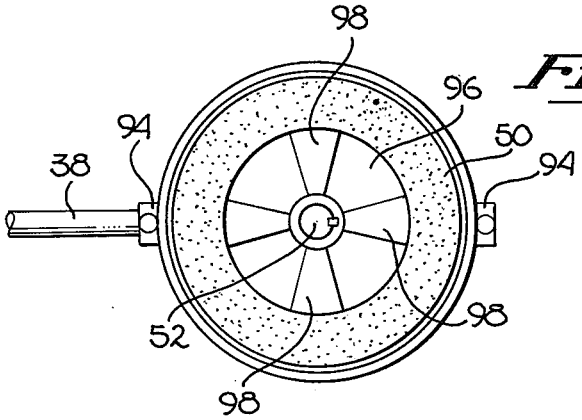
Fig. 5
Fig. 6
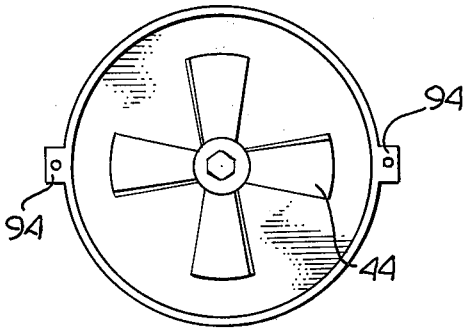
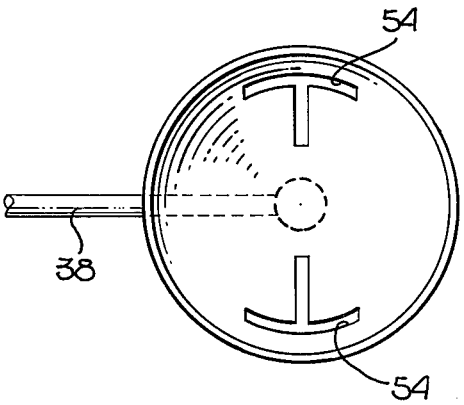
Fig. 7

MACHINE FOR CLEANING THE BOTTOM OF BOATS

BACKGROUND OF THE INVENTION

1. Field of the Invention

This invention relates to the field of boat hull cleaning devices which can be used to clean the boat hull while in the water, and more specifically, to a boat hull cleaning apparatus having a plurality of uniquely designed brushing devices.

2. Prior Art

The need for boat bottom cleaning apparatuses is well known in the art. This need is due to the fact that a boat's performance, especially larger boats having lengths in excess of 30 feet, is related to the ability of the boat hull to slide through the water. If the boat hull is dirty or should various underwater marine growths be attached to the hull, the performance of the boat will be substantially diminished. This results in greater fuel consumption of a boat having a fouled bottom than a boat having a clean bottom. Thus, it is well recognized that to improve boat performance, the bottom of the boat should be free of all rough surfaces so as to be substantially smooth. In the past, various types of anti-fouling and toxic bottom paints have been used on boat hulls. These types of paints provide an extremely smooth surface and are used to prevent marine growths from growing on the hull. Such paints have been widely used because many times boats cannot be economically kept out of the water when not in use, i.e., larger boats constantly remain in the water which increases the likelihood of marine growth. However, such paints have been found not to be effective in preventing the multiplicity of types of marine growth which are known to grow on ships' hulls. Moreover, with this method of preventing marine growth, the boat bottom cannot be cleaned by all scraping system as many scraping means are very likely to also remove the anti-fouling paint.

In response to this problem, the prior art has developed a number of boat cleaning apparatuses which are used on the boat hull while the boat is in the water. However, as will be shown such boat cleaning apparatuses contain a number of shortcomings. One such apparatus is disclosed by Campbell, U.S. Pat. No. 3,227,124. The boat cleaning apparatus of Campbell comprises a brushing unit coupled to two floating pontoon members. The brushing unit is coupled to the pontoon members such that when a boat is drawn between the pontoon members, the brushes rotate against boat hull. In such an apparatus, the brushes are disposed on a cylindrical member extending transversely beneath the boat bottom and rotate such that the bristles of the brushing unit symmetrically abrade against the boat hull. This is because the bristles are arranged in cylindrical configuration such that as the cylinder member is rotated, each bristle travels in the same direction and abrades against the boat hull in only this direction. Such an apparatus suffers from a number of shortcomings. For example, because the bristles are orthogonally disposed on the brushing unit with respect to the axis of rotation it has been found that the resistance of such bristles through the water is so great that such bristles are substantially bent by the time they make contact with the boat hull. This reduces the abrading effect of the brush against the boat hull. Thus, a specific point on the boat hull is only subjected to bristles moving in one direction and substantially bent.

It has been found that such cleaning action does not remove a large number of marine growths. In addition, such type of cylindrical bristles require a great deal of power to rotate them in water. The device of Campbell also requires a complex pump mechanism for driving the bristles and a separate system for raising and lowering the brushes. Finally, the brushing unit of Campbell calls for an upward extending joining member which couples each of the pontoons together. Such a member prevents boats having high superstructures such as, for example, sail boats and the like, from passing beneath such upwardly extending joining member.

Another prior art cleaning device is disclosed by Browne, U.S. Pat. No. 1,079,208. In the Browne device, an apparatus having a propeller is lowered into the water and the action of the propeller positions the device against the boat hull. As the device is moved down the side of the boat by a crane, rollers scrape off the algae and other growth on the boat hull. However, such devices also suffer a number of shortcomings in that in order to clean one boat hull such device must be repositioned along the boat hull in order to effectively clean the entire hull. Moreover, as with the Campbell device, the means used to clean the boat hull rotates in only one direction and thus a point on the boat hull is only subjected to abrading bristles or other abrasion means which move in one direction. Moreover, a complex crane system is required to position the device against the boat hull.

Yet another prior art boat cleaning device is disclosed by Sieple, U.S. Pat. No. 3,752,109. In the Sieple device a floating-type platform is ballasted and trimmed to allow the passage of a ship through a channel. A plurality of cylindrically shaped brushing units are brought to bear against the ship hull such that the brushes clean the marine growth therefrom. As discussed hereinabove, such brushes only acts in one direction against the boat hull and therefore suffers the above-mentioned shortcomings. Moreover, such a floating-type platform which must be raised and lowered beneath the boat hull requires expensive and complex flotation equipment which raises the cost of such apparatus. Finally, such a device positions the brushing units by means of a plurality of hydraulic rams which must be protected from a water environment.

The present invention provides a boat cleaning apparatus which contains none of the shortcomings of the prior art. Because the brushing device of the present invention has cleaning bristles extending outwardly from a flat base member, rotation of the base member causes substantially all of the bristles to simultaneously engage the boat hull. Moreover, because the cleaning bristles are substantially parallel to the axis of rotation of the base member, an asymmetrical brushing action is created. This asymmetrical brushing action delivers a plurality of directional forces to any given point on the boat hull thereby effectively cleaning dirt and tenacious marine growths therefrom. This cleaning action is provided by a motor means which is used to position the brushing device adjacent the boat hull. The present invention also provides a uniquely designed pontoon configuration which permits boats of various designs to pass therethrough and be cleaned by the brushing devices.

SUMMARY OF THE INVENTION

This invention is directed to a boat hull cleaning apparatus which is designed to clean a plurality of differently shaped boat hulls. This is achieved by providing the apparatus with a plurality of uniquely designed and located rotatable brushing devices each brushing device being disposed in an associated housing and having cleaning means such as, for example, bristles and the like, extending outwardly therefrom. The housing is coupled to an elongated arm member which extends below the surface of the water such that when the device is disposed adjacent the boat hull, substantially all of the cleaning means engage a predetermined area thereof. A motor is coupled to the brushing device for both rotating the positioning the brushing device and has an associated rotatable shaft. The shaft has a propeller disposed at the first end thereof and the cleaning means disposed at the second end thereof. Rotation of the shaft causes the propeller to rotate thereby encouraging the brushing device and housing toward the boat hull and simultaneously causes the bristling device to rotate. A plurality of cleaning devices are arranged in a horizontal and vertical configuration between two spaced apart pontoon members. The pontoon members are arranged so as to be in substantial parallel and spaced apart configuration. This permits boats of varying beams to pass therethrough. The cleaning devices are then actuated and move until they engage the boat hull and keel. The cleaning action of the boat hull begins when the boat is over the cleaning devices and the devices have abradingly engaged said hull and keel.

It is therefore one object of the present invention to provide a hull cleaning apparatus for removing drag-inducing dirt and marine growths.

Another object of the invention is to provide a boat hull cleaning device which is ecologically operatable in a marine environment.

Yet another object of the present invention is to provide a cleaning device which is capable of accommodating variously configured boat hulls of varying sizes.

The novel features which are believed to be characteristic of this invention, both as to its organization and method of operation, together with the further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only and not intended as a definition of the limits of the invention.

BRIEF DESCRIPTION OF THE DRAWINGS

FIG. 4 is a sectional view of the brushing unit of the present invention showing the rotatable brushing head, the outwardly extending bristles, and the motor means used to position the brushing unit and to rotate the bristle members.

FIG. 5 is a cross-sectional view taken through lines 5—5 of FIG. 4 and showing the brushing head having a substantially annular configuration.

FIG. 6 is a sectional view taken through lines 6—6 of FIG. 4 showing the propeller members used to propel the cleaning head against the ship hull.

FIG. 7 is a sectional view taken through lines 7—7 of FIG. 4 showing the openings or outlets disposed through the back of the brushing device such that water moved by the propellers exits out the back of the brushing unit.

DETAILED DESCRIPTION OF THE INVENTION

Figure 1:
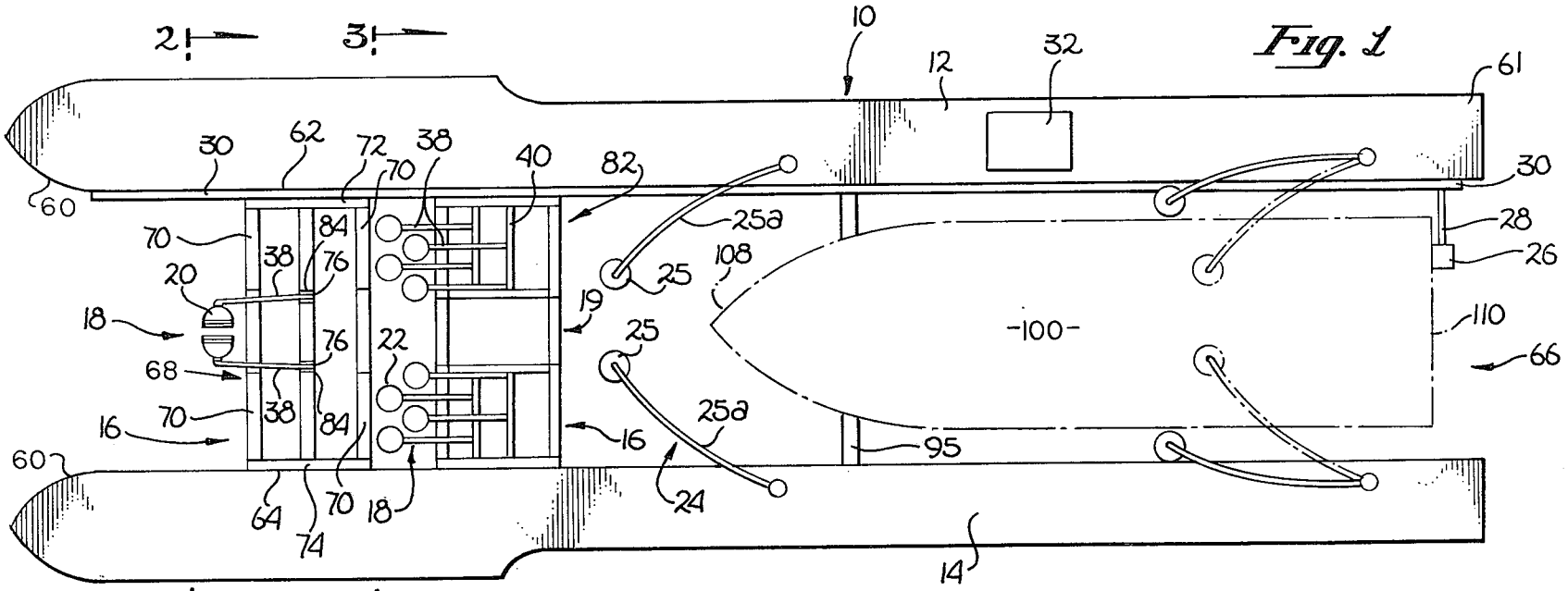
FIG. 1 is a top plane view of the cleaning apparatus of the present invention showing the spaced apart pontoon members and the plurality of brushing units disposed between the pontoons adjacent the front section thereof.
Figure 2:
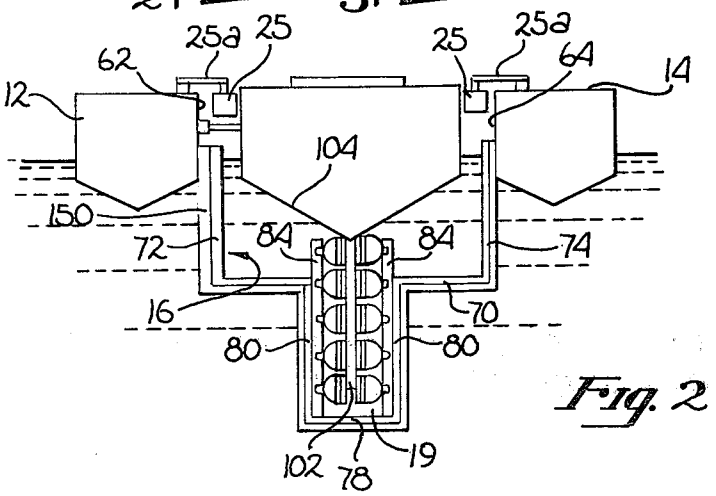
FIG. 2 is a sectional view taken through lines 2—2 of FIG. 1 showing the vertical brushing units disposed in a substantially parallel and spaced apart configuration.
Figure 3:
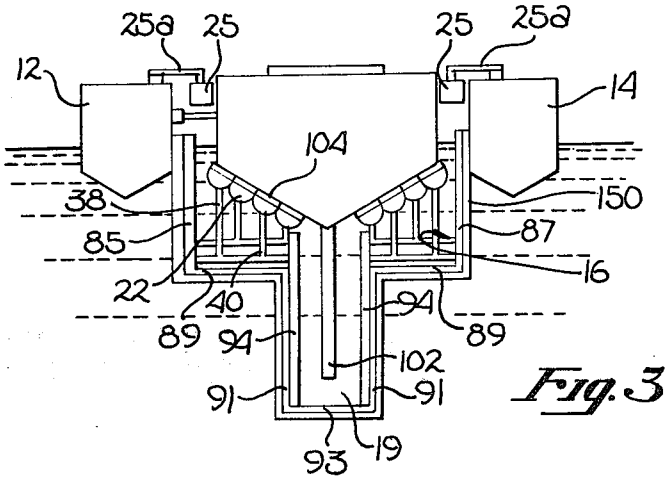
FIG. 3 is a sectional view taken through lines 3—3 of FIG. 1 showing the horizontal brushing units which have been actuated so as to engage a boat hull.

Referring first to FIGS. 1–3, there is shown, as a presently preferred embodiment, a boat cleaning apparatus 10 having first pontoon member 12 and second pontoon member 14 disposed in a substantially parallel and spaced apart configuration. The pontoon members are arranged and configured such that a space or area 66 exists between the pontoon members of a predetermined distance permitting boat hulls of various beams to pass therethrough. No structure which extends over the top of the water is necessary; the pontoons being coupled together by a uniquely designed underwater structural framework 16. This permits boats having extended superstructures to easily pass between pontoon members 12 and 14.

Structural framework 16 is welded or otherwise joined to each of the pontoon members and extends downwardly into the water a sufficient distance to permit the passage of boats having varying water lines to pass therethrough. Note that structural framework 16 forms a downward extending central section 19 which permits boat keels to pass through apparatus 10. A plurality of brushing units or cleaning devices 18 are coupled to the structural framework 16. Such brushing units are arranged such that there are vertical head members 20 and horizontal head members 22. Brushing units 18 are coupled to structural framework 16 so as to be disposed adjacent the front or bow end 60 of pontoons 12 and 14. Brushing units 18 represent a point of novelty of the present invention and a distinct improvement over the prior art. These brushing units 18 enable the boat cleaning apparatus 10 to thoroughly and effectively clean various shaped boat hull because of the configuration of such units 18. Moreover, because such units are powered in a unique manner, the brushing device or other cleaning means is simultaneously positioned against boat hull 104 and abradingly engages same. Such brushing units will be discussed in more detail hereinafter.

Guide rollers 24 are disposed on the pontoons 12 and 14 adjacent the central area and back or stern end 61 thereof. Guide rollers 24 encourage the centering of boat 100 such that as boat 100 proceeds through pontoons 12 and 14 proper location of boat hull 104 over brushing units 18 is maintained. Such centering action can be extremely important inasmuch as this enables boats of different beams to use the same cleaning apparatus 10. Thus the area 66 between pontoons 12 and 14 need not be changed. In the presently preferred embodiment, guide rollers 24 are comprised of rollers 25 disposed at the end of roller arm **25*a*. Arms 25*a* are coupled to the pontoons 12 and 14 by spring loaded pivots which encourage rollers 25 against the sides of boat 100. Of course other means for centering boat 100** and maintaining such position are also within the scope of this invention. For example, inward extending horizontal arm members and the like can also be used.

Also on pontoon 12 adjacent stern end 61 is a means for propelling the boat between the pontoon members by pushing the boat 100 from the stern end 110 thereof. In the presently preferred embodiment, such means comprises a pusher bar 26 coupled to an outwardly extending rod member 28. Rod member 28 is joined to a chain drive mechanism 30. Mechanism 30 extends along the length of pontoon member 12 such that the boat can be pushed substantially through the pontoon members and over the brushing unit 18. While such a chain-driven conveyor system is well known in the art, it has been found that pushing boat 100 between pontoons 12 and 14 is easier and prevents undesirable movement of the boat 100 better than pulling the boat 100 therethrough.

In order to provide the necessary power for the brushing unit 18 and means for propelling the boat between the pontoon members 12 and 14, a power plant 32 is preferably disposed on one of the pontoon members. Such power plant 32 is coupled by well known means to the brushing units 18 and the pusher bar 26 and supplies necessary power to perform these functions. Power plant 32 may contain diesel or gasoline engines used to drive hydraulic pumps or generators to power the brushing units 18.

Referring now to FIGS. 2 and 3, one can see that the forward section 68 of the structural framework 16 which couples each of the two pontoons together is comprised of two downwardly extending sections 72 and 74 coupled to inwardly extending horizontal supporting members 70 which extend downward forming side members 80. Finally, supporting structure 16, which is joined to inside sections 62 and 64 of pontoons 12 and 14 respectively, couples such pontoon members together by means of bottom member 78. Member 78 and members 80 being joined together to form downward extending area 19 and adapted to permit keels, such as keel member 102 to pass therethrough. Side members 80 and bottom member 78 are also referred to as the vertical head supporting section used to support vertical head members 20; more specifically, in the presently preferred embodiment, vertical head members 20 are rotatably coupled to support section 84 by means of a rotatable arm member 38 hereinafter described. Arm members 38 extend from section 84 toward the front 60 of the pontoons 12 and 14 in a spaced apart configuration. As indicated by reference to FIGS. 1 and 2, vertical head members 20 face each other in a substantially parallel and spaced apart configuration such that the keel 102 of boat 100 may pass between such head members.

Indicated in FIG. 3 are the horizontal head members 22 which have been actuated so as to extend upwardly and thereby engage the hull 104 of boat 100. Such horizontal head members are also rotatably coupled to the middle section 82 of framework 16 by means of coupling arms 40. In the presently preferred embodiment, middle section 82 is coupled to downward extending center sections 85 and 87, which, in turn, are respectively joined to inward extending horizontal members 89. Members 89 form downward extending section 91 which terminates in horizontal section. Sections 91 and 93 forming area 19 hereinabove discussed. Coupling arms 40 are disposed between sections 85 and 94 of the supporting structure 16. In the present preferred embodiment, a rear supporting section 95 is also used to securely join pontoons 12 and 14 together.

Referring now to FIG. 4, brushing unit 18 is shown as comprised of a brushing housing 34 which in turn is comprised of back member 88 and front member 90. Back member 88 has a generally circular cross section and is arranged such that water is channeled out the back of member 88 through openings 54 as hereinafter described. The front member 90 is coupled to back member 88 by means of bolts 92 disposed through flange members 94. Of course, it is understood that other means for coupling the back and front members together are within the scope of this invention.

Disposed in the brushing housing 34, and more specifically, in the front member 90, is a motor 42. Such motors for underwater use are well known in the art and will not be discussed in detail herein. In the presently preferred embodiment, motor 42 is circumferentially disposed in housing 34 by means of axially disposing it in circular flange 43. Motor 42 has a shaft 52, and rotatably disposed at one end of shaft 52 is the brushing device 47. Brushing device 47 comprise a substantially flat rotatable base member 48 having an axis of rotation, and cleaning means disposed on such base member 48. For example, base 48 has outwardly extending bristle members 50 disposed thereon. Bristle members 50 preferably line in a common plane so as to be substantially parallel to the axis of rotation of base member 48. Bristle members 50 are the cleaning means used to abradingly engage the hull 104 of the boat 100. Other abrading means such as, for example, sand paper, and other abrading surfaces can also be disposed on base member 48. Coupled to the other end of shaft 52 is propeller 44. Propeller 44 is disposed in housing 34 so as to face openings 54. In the presently preferred embodiment, propeller 44 is comprised of four vanes or blades which are caused to rotate upon rotation of shaft 52. As indicated in FIG. 4, rotation of shaft 52 causes said propeller and said base member to simultaneously rotate.

The entire brush housing 34 is coupled to first end 37 of arm 38 via ball joint 36. This permits the housing to move in a plurality of positions as indicated in FIG. 4 by dotted lines. The second end 39 of arm 38 contains a coupling 76 which is disposed about coupling arm 40 and may contain a sleeve member 77 disposed thereinbetween. This permits the arm 38 to rotate about the coupling arm 40 such that the housing 34 can be positioned into a plurality of predetermined positions.

Reference to FIGS. 5 through 7 indicates various other aspects of the brushing units 18 of the present invention. For example, FIG. 5 points out that the brush bristles 50 are disposed on base member 48 so as to form an annular or toroidal configuration. Note also that base member 48 has open areas 96 on either side of arms 98. These open areas 96 permits water to pass through the base member 48 and into the interior of housing 34. Arms 98 also represent a point of novelty of the present invention in that they act as a second impeller means to position the housing 34. Arms or propellers 98 act and can be shaped substantially as described with reference to propeller 44.

In operating the apparatus 10 of the present invention, the bow 108 of boat 100 is moved into position between pontoon members 12 and 14. However, once in position, the boat engine is turned off and the stern 110 of boat 100 is pushed through the apparatus by means of pushing member 26. Various guide rollers 24 are also disposed on the pontoon members and engage the boat in various locations such that the boat is properly guided through areas 66 between the two pontoon members 12 and 14. Note that guide rollers 24, in their rest position extend toward the central area between pontoons 12 and 14. This is because they are coupled to the pontoons by means of spring loaded pivot members. As the boat 100 is pushed forward because rod 28 is caused to travel down the moving chains 30, the boat 100 flexes guide rollers 24 outward.

As the push bar 26 moves along, the boat hull 104 will eventually be disposed over the brushing units 18. Once in this position, the brushing units, and more specifically, horizontal heads 22 and/or vertical heads 20, are actuated. Actuation is achieved by engaging motor 42 so as to cause shaft 52 to rotate. Inasmuch as the base member 48 is disposed at one end of shaft 52, it too will rotate causing arms 98 to drive the housing 34.

Shaft 52 is also coupled to propeller 44, and thus rotation of shaft 52 will also cause propeller 44 to rotate. Because base 48 permits water into the interior of housing 34, propeller 44 will force the water out through opening 54 thereby moving the entire housing 34 until it matingly engages with either the boat hull 104 or the keel 102. The specific rotation of the propeller 44 is governed such that just sufficient pressure between the bristles 50 and the boat hull or keel is maintained. Rotation of base member 48 and the attached bristle members 50 causes the bristle members 50 to bend somewhat in an outward direction because of centrifugal forces. Moreover, bristle members 50 will also bend backwards compared to the direction in which they are being rotated because of their resistance to the water. However, notwithstanding such bending action, the bristles 50, because they are all parallel to the axis of rotation of the base member 48, provide a given point on the boat hull 104 with an asymmetrical brushing action. In a typical brushing unit of the prior art, the brushes are rotated about a cylindrical base. This means that a given point on the boat hull will be cleaned by a bristle moving in a one-direction wiping action. In the present invention, as the boat 100 moves over the cleaning device, the bristle members 50 will subject a given point to cleaning forces from many different angles. It has been found that such type cleaning action is extremely efficient in removing tenacious growths from a given surface. Moreover, the radial brushing units 18 of the present invention only have bristle members on one surface thereof and thus the power need to rotate such a cleaning device is substantially less than for a cylindrical brush.

Referring again to FIG. 4, one can see that housing 34 is rotatable because of ball joint 36 as indicated by the dashed lines. In the presently preferred embodiment, housing 34 can pivot approximately 60° in any direction about ball joint 36. This enables housing 34 to engage differently shaped boat hulls such that substantially all the bristles 50 will matingly engage the same (for example, see FIG. 2). The fact that the housing 34 is rotatable in the above-described manner is a further advantage of the present invention. Of course, other means for rotating the housing 34, such as movable arm members, is also within the scope of this invention. This advantage is further improved upon because arm 38 is permitted to pivot up to about 90° about coupling members 40 or supporting members 84.

After the boat 100 has passed through the apparatus 10, the brushing units 18 are shut off. This causes the units 18 to return to their original position because of the action of joint member 76. However, the structural framework 16 is preferably mounted in another framework 150 which permits framework 16 to be raised entirely out of the water. This prolongs the life of the units 18 and makes maintenance above water possible.

In the presently preferred embodiment, the pontoons can either be made of steel or fiberglass. The brushing units 18 are preferably made of stainless steel or other non-rustable material inasmuch as such units can be subjected to a salt water environment. The hulls are sufficiently buoyant to support the brushing units, house the power supply necessary to operate all of the above-described equipment, and may actually contain a motor which would enable the pontoons to be movable in the water. Other optional features of the present invention include holding screens coupled to the pontoons and disposed under the brushing units 18 so as to catch the marine growth as it is being removed because of the brushing action on the boat hull. Such screens would then ecologically protect sea life near the operation.

In another embodiment, three such housings are mounted in a remote controlled unit. Such unit is then attached to the boat hull (by the action of the propellers in the housing) and is controlled from a remote location as to the specific direction of movement along the ship's hull. This embodiment has particular utility for larger ships.

Although this invention has been disclosed and described with reference to a particular embodiment, the principles involved are susceptible to other applications which will be apparent to persons skilled in the art. For example, in the presently preferred embodiment, the axis of the housing 34 coincide with the axis of the shaft 52. Other configurations of the housing 34 and the motor 42 and associated shaft 52 are also within the scope of this invention. While in the preferred embodiment a propeller means was disclosed as providing the method of positioning the housing 34 against the boat hull 104, other means for moving the housing 34 are also within the scope of this invention. Such other means would include, for example, movable arm members and the like. Finally, the housings 34 can be mounted to the stationary platform structure, i.e., without the pontoons described hereinabove. Thus, this invention is not intended to be limited to the particular embodiment herein disclosed.

I claim:

1. A boat hull cleaning apparatus comprising:

a. a plurality of brushing devices coupled to a supporting structure, said supporting structure being coupled to spaced apart pontoons such that a boat can pass thereinbetween, said brushing devices each having a rotatable base member, said base member being substantially flat with a plurality of bristle heads extending outwardly from said base member forming an annulus, substantially all said bristles lying in a common plane;

b. motor means coupled to each said brushing device for rotating and positioning each said brushing device, said motor means comprising a motor and an associated rotatable shaft, said shaft having at least one blade disposed at a first end thereof, and said base member disposed at a second end thereof, whereby rotation of said shaft causes (i)

said blade to rotate thereby encouraging each associated brushing device toward said boat hull, and (ii) each associated base member to rotate.

2. The boat cleaning apparatus of claim 1 wherein means for moving said boat over said plurality of brushing devices is disposed on one of said pontoons, said means for moving said boat comprising an outward extending pusher bar coupled to means for moving said pusher bar, said pusher bar adapted to engage one end of said boat and push said boat between said pontoons and over said brushing devices.

3. The boat cleaning apparatus of claim 1 wherein said base member has a plurality of arm members, said arm members configured such that rotation of said base member causes said arm members to encourage said brushing unit toward said boat hull.

4. The boat cleaning apparatus of claim 1 wherein said brushing device has a housing comprised of an open front section coupled to a back section, said base member being disposed in said front section and said back section having at least one opening through which water may pass.

5. A boat hull cleaning apparatus comprising:

a. a plurality of brushing devices each disposed within an associated housing and coupled to a supporting structure, each housing being located below the surface of a body of water when in normal use, each said brushing device having a rotatable base member with a plurality of cleaning surfaces extending outwardly therefrom such that substantially all said cleaning surfaces lie in a common plane, said base member having an opening so as to permit water to pass therethrough;

b. motor means disposed within each associated housing and coupled to an associated brushing device for positioning and rotating said brushing device, said motor means comprising a motor and an associated rotatable shaft, said shaft having at least one blade disposed at a front end thereof, configured for moving said brushing devices toward a boat hull, and said base member disposed at a second end thereof, said housing having an opening adjacent said blade such that as said blade rotates, water enters said housing through the opening in said base member and is forced out through the opening in said housing.

6. The boat cleaning apparatus of claim 5 wherein said supporting structure is coupled to spaced apart pontoons, said pontoons arranged and configured such that a boat can pass thereinbetween.

7. The boat cleaning apparatus of claim 5 wherein means for moving said boat over said plurality of cleaning device is disposed on one of said pontoons, said means for moving said boat comprising an outward extending pusher bar coupled to means for moving said pusher bar, said pusher bar adapted to engage one end of said boat and push said boat between said pontoons and over said brushing devices.

8. The boat cleaning apparatus of claim 5 wherein said base member has a plurality of arm members, said arm members configured such that rotation of said base member causes said arm members to encourage said brushing unit toward said boat hull.

9. The boat cleaning apparatus of claim 5 wherein each said housing is rotatably coupled to said supporting structure such that when said brushing device is disposed adjacent a boat hull, substantially all said cleaning surfaces engage said hull.

10. The boat cleaning apparatus of claim 5 wherein said cleaning surfaces are outwardly extending bristles in an annulus configuration.

* * * * *